United States Patent [19]

Löliger

[11] 4,037,996

[45] July 26, 1977

[54] VOLUMETRIC PUMP

[75] Inventor: Willi Löliger, Konolfingen, Switzerland

[73] Assignee: Alpura Koreco A.G., Konolfingen, Switzerland

[21] Appl. No.: 632,770

[22] Filed: Nov. 17, 1975

[30] Foreign Application Priority Data

Nov. 22, 1974 Switzerland ..... 15538/74

[51] Int. Cl.[2] ..... F04B 7/00

[52] U.S. Cl. ..... 417/518

[58] Field of Search ..... 417/244, 254, 258, 518, 417/517; 141/146; 222/380, 409

[56] References Cited

U.S. PATENT DOCUMENTS

| | | | |
|---|---|---|---|
| 1,287,325 | 12/1918 | Maggi | 417/244 |
| 2,798,662 | 7/1957 | Evans | 417/244 |
| 3,168,225 | 2/1965 | Miller et al. | 141/146 |

*Primary Examiner*—Carlton R. Croyle
*Assistant Examiner*—G. P, La Pointe
*Attorney, Agent, or Firm*—Kenyon & Kenyon, Reilly, Carr & Chapin

[57] ABSTRACT

Volumetric pump with a cylinder and a piston reciprocably driven therein, comprising an inlet at one end of the cylinder, ports at each end of the cylinder connected by a passage and a valve controlling the flow in said passage, and a closable outlet connected with the cylinder port at the cylinder end opposite the inlet end.

5 Claims, 1 Drawing Figure

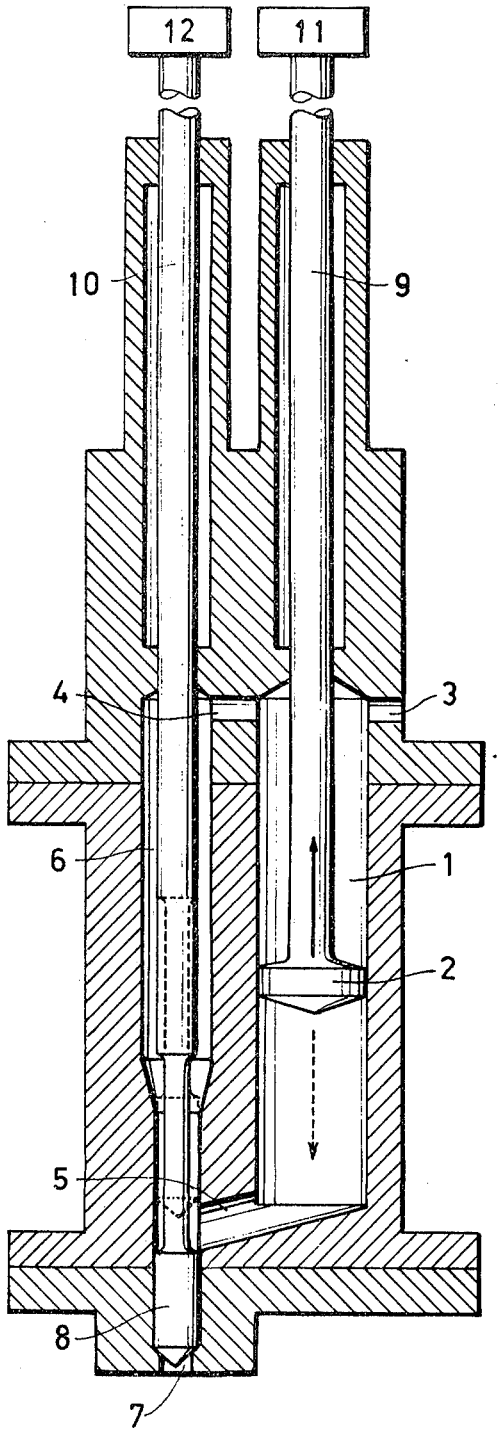
12
11
10
9
4
3
6
1
2
5
8
7

VOLUMETRIC PUMP

The invention relates to a volumetric pump and more particularly, the invention relates to a volumetric pump intended but not exclusively, for aseptically metering liquid or viscous products.

The pump according to the invention, with a cylinder and a piston reciprocably driven therein, comprises an inlet at one end of the cylinder, ports at each end of the cylinder connected by a passage and a valve controlling the flow in said passage, and a closable outlet connected with the cylinder port at the cylinder end opposite the inlet end.

In a preferred embodiment, the passage and the outlet are closable by the same valve.

The accompanying drawing shows as an example an embodiment of the invention.

The FIGURE is a longitudinal section of a pump according to the invention.

Referring to the drawing, the pump has a cylinder chamber 1 in which a piston 2 mounted on a piston rod 9 is reciprocally driven via a motor 11. In addition, the pump has an inlet 3 which communicates with an upper end of the cylinder chamber 1, as viewed, to deliver a liquid or viscous product thereto.

A pair of ports 4, 5, each located at a respective end of the cylinder chamber 1 connect the cylinder chamber 1 with an adjacent passage 6 in the pump. This passage 6, as shown, extends from the upper part 4 from the cylinder chamber 1 past the lower port 5 to an outlet 7. In addition, the passage 6 has a reduced section near the lower end which extends to above the port 5.

A valve 8 is mounted within the passage 6 to move between a position, shown is full lines, closing the outlet 7 and a position, shown in dotted line, closing the passage 6 to the outlet 7 while opening the port 5 of the cylinder chamber 1 to the outlet 7. To this end, the valve 8 is mounted on a piston rod 10 which is reciprocally driven via a means 12 such as a hydraulic cylinder or a manually operated means. As shown, the piston rod 10 has a section of reduced cross-section upstream of the valve 8. This section, when the valve 8 is in the outlet closing position shown in full lines, extends upwardly past the reduced section of the passage 6 and provides a clearance so that the upper part of the cylinder chamber 1 is in communication with the lower part of the cylinder chamber 1. When the valve 8 is in the upper position shown in dotted lines, the passage 6 is closed relative to the outlet 7, the valve 8 being of the same diameter as the reduced section of the passage 6.

The valve 8 thus acts as a means for selectively opening and closing the ports 4, 5 to each other and for selectively connecting the outlet 7 to the cylinder chamber 1 upon closing of the ports 4, 5 to each other and closing the outlet 7 to the cylinder chamber 1 upon opening of the ports 4, 5 to each other.

In a preferred embodiment the piston rod 9 and the valve rod 10 each pass through a gland according to U.S. Pat. No. 3,909,014.

The operation of the pump is as follows:

The valve 8 being in the upper position shown by dotted lines, the passage 6 is closed and the outlet 7 open. The piston 2 is then moved down (as shown by the dotted arrow) and draws the product through the inlet 3 into the upper part of the cylinder chamber 1. If the lower part of the cylinder chamber 1 is already filled, its content is delivered through the outlet 7.

The valve 8 is then moved to the lower position (shown by full lines). The outlet 7 is thus closed and the passage 6 communicates with both ends of the cylinder chamber 1 via the ports 4, 5. As the piston 2 moves up (according to the full line arrow), the product passes from the upper part of the cylinder chamber 1 through the port 4, the passage 6 and the port 5 into the lower part of the cylinder chamber 1.

However, the acting surface of the piston 2 is not the same on both sides, the upper face being in part obliterated by the piston rod. In consequence, during the upward stroke of the piston 2, the volume sucked into the lower part of the cylinder 1 is greater than the volume expelled out of the upper part of the cylinder 1. The difference, corresponding to the piston rod section multiplied by its stroke, is drawn into the upper part of the cylinder 1 through the inlet 3. Since a suction force is created during both reciprocating movements of the piston 2, a non-return valve can be dispensed with in the inlet 3.

The above described pump presents various advantages:

Due to the fact that the piston 2 is surrounded by the product on both faces, the pressure differential between the faces is small. Air (and consequently microorganisms) cannot pass from one face to the other. Also, the product is not exposed to the heat which may come from one side of the piston 2.

If the piston speed during the down stroke is smaller than the upwards stroke, that is, if the delivery stroke is slower than in the other direction, the product is expelled progressively through the outlet 7 without splashing, whereas a rapid return upwards maintains an optimum efficiency.

I claim:

1. Volumetric pump comprising a cylinder chamber, a piston reciprocably driven in said cylinder chamber, an inlet at one end of said cylinder chamber, ports at each end of said cylinder chamber, a passage connected to and between said ports, a valve movably mounted in said passage for controlling the flow in said passage, means outside said cylinder chamber for driving said valve in said passage, and a closable outlet connected with the cylinder port at the cylinder end opposite the inlet end.

2. A pump as claimed in claim 1, in which the piston speed during the delivery stroke is slower than during the stroke in the direction opposite to the delivery stroke.

3. A volumetric pump comprising a cylinder chamber having an inlet at one end and a pair of ports, each said port being located at opposite ends of said chamber;

a piston reciprocally mounted in said cylinder chamber;

a passage connected to said ports and having an outlet at one end; and a valve reciprocally mounted in said passage to move between a first position closing said outlet and a second position closing said passage to said outlet while opening one of said ports to said outlet whereby with said valve in said second position a product in a part of said cylinder chamber between said piston and said one port can be expelled through said outlet while additional product is drawn into said chamber through said inlet during a delivery stroke of said piston towards said outlet and with said valve in said first position a product can be drawn into said part of said cylinder via said passage during a stroke of said piston away from said outlet.

4. In a volumetric pump, the combination comprising a cylinder chamber having an inlet at one end and a pair of ports, each said port being located at opposite ends of said chamber;

a piston reciprocally mounted in said cylinder chamber;

a passage connected to and between said ports;

an outlet; and means for selectively opening and closing said ports to each other and for selectively connecting said outlet to said cylinder chamber upon closing of said ports to each other and closing said outlet to said cylinder chamber upon opening of said ports to each other, said means including a valve in said passage movable between a first position closing said outlet and opening said ports to each other and a second position opening said outlet to one of said ports while closing said ports to each other.

5. Volumetric pump comprising a cylinder chamber, a piston reciprocably driven in said cylinder chamber, an inlet at one end of said cylinder chamber, ports at each end of said cylinder chamber, a passage connected to and between said ports, a valve controlling the flow in said passage, and a closable outlet connected with the cylinder port at the cylinder end opposite the inlet end, said passage and said outlet being closable by said valve.

* * * * *